US010465259B2

(12) United States Patent
Takajo et al.

(10) Patent No.: US 10,465,259 B2
(45) Date of Patent: Nov. 5, 2019

(54) GRAIN-ORIENTED ELECTRICAL STEEL SHEET AND PRODUCTION METHOD THEREFOR

(71) Applicant: JFE STEEL CORPORATION, Chiyoda-ku, Tokyo (JP)

(72) Inventors: Shigehiro Takajo, Tokyo (JP); Takeshi Omura, Tokyo (JP); Seiji Okabe, Tokyo (JP)

(73) Assignee: JFE STEEL CORPORATION, Chiyoda-ku, Tokyo (JP)

( * ) Notice: Subject to any disclaimer, the term of this patent is extended or adjusted under 35 U.S.C. 154(b) by 296 days.

(21) Appl. No.: 15/552,297

(22) PCT Filed: Feb. 12, 2016

(86) PCT No.: PCT/JP2016/000745
§ 371 (c)(1),
(2) Date: Aug. 21, 2017

(87) PCT Pub. No.: WO2016/136176
PCT Pub. Date: Sep. 1, 2016

(65) Prior Publication Data

US 2018/0037965 A1 Feb. 8, 2018

(30) Foreign Application Priority Data

Feb. 24, 2015 (JP) ..... 2015-034204

(51) Int. Cl.
*C21D 8/12* (2006.01)
*C21D 9/46* (2006.01)
(Continued)

(52) U.S. Cl.
CPC ..... *C21D 8/1294* (2013.01); *C21D 8/12* (2013.01); *C21D 8/1288* (2013.01); *C21D 9/46* (2013.01);
(Continued)

(58) Field of Classification Search
CPC .... C21D 2201/05; C21D 8/12; C21D 8/1288; C21D 8/1294; C21D 9/46; H01F 1/16; H01F 27/245
See application file for complete search history.

(56) References Cited

U.S. PATENT DOCUMENTS 6,482,271 B2 11/2002 Sakai et al.
9,646,749 B2 5/2017 Suehiro et al.
(Continued)

FOREIGN PATENT DOCUMENTS

CN 104011241 A 8/2014
EP 0870843 A1 10/1998
(Continued)

OTHER PUBLICATIONS

Feb. 1, 2018, the Extended European Search Report issued by the European Patent Office in the corresponding European Patent Application No. 16754930.2.
(Continued)

*Primary Examiner* — Jenny R Wu
(74) *Attorney, Agent, or Firm* — Kenja IP Law PC

(57) ABSTRACT

Disclosed are a grain-oriented electrical steel sheet having strain regions extending in a direction transverse to a rolling direction at periodic interval s (mm) in the rolling direction. Each strain region has a closure domain region whose width in the rolling direction varies periodically on a steel sheet surface. Each closure domain region satisfies: $W_{max}/W_{min}$=1.2 or more and less than 2.5, where $W_{max}$ and $W_{min}$ respectively denote a maximum width and a minimum width on the steel sheet surface as measured in the rolling direction; $W_{ave}$ being 80 μm or more, where $W_{ave}$ denotes an average width on the steel sheet surface as measured in the rolling direction; D being 32 μm or more, where D denotes a maximum depth as measured in the sheet thickness direc-
(Continued)

tion; and ($W_{ave}$*D)/s being 0.0007 mm or more and 0.0016 mm or less.

8 Claims, 6 Drawing Sheets

(51) Int. Cl.
*H01F 1/16* (2006.01)
*H01F 27/245* (2006.01)

(52) U.S. Cl.
CPC ..... *H01F 1/16* (2013.01); *H01F 27/245* (2013.01); *C21D 2201/05* (2013.01)

(56) References Cited

U.S. PATENT DOCUMENTS

| | | | |
|---|---|---|---|
| 2013/0143050 | A1 | 6/2013 | Omura et al. |
| 2013/0206283 | A1 | 8/2013 | Inoue et al. |
| 2014/0360629 | A1 | 12/2014 | Inoue et al. |
| 2015/0034211 | A1 | 2/2015 | Takajo et al. |
| 2015/0187474 | A1 | 7/2015 | Takajo et al. |
| 2015/0310973 | A1 | 10/2015 | Takajo et al. |

FOREIGN PATENT DOCUMENTS

| | | | |
|---|---|---|---|
| JP | 2012036445 | A | 2/2012 |
| JP | 2012036450 | A | 2/2012 |
| JP | 2012052233 | A | 3/2012 |
| JP | 2012172191 | A | 9/2012 |
| RU | 2016094 | C1 | 7/1994 |
| RU | 2501866 | C1 | 12/2013 |
| WO | 9724466 | A1 | 7/1997 |
| WO | 2012017693 | A1 | 2/2012 |
| WO | 2013099258 | A1 | 7/2013 |
| WO | 2013099272 | A1 | 7/2013 |
| WO | 2014034128 | A1 | 3/2014 |
| WO | 2013099272 | A8 | 5/2014 |
| WO | 2014068962 | A1 | 5/2014 |

OTHER PUBLICATIONS

Apr. 26, 2018, Office Action issued by the State Intellectual Property Office in the corresponding Chinese Patent Application No. 201680011631.0 with English language Search Report.

Apr. 26, 2016, International Search Report issued in the International Patent Application No. PCT/JP2016/000745.

Sep. 28, 2018, Office Action issued by the Federal Service for Intellectual Property, Patents and Trademarks of the Russian Federation in the corresponding Russian Patent Application No. 2017133030 with English language Search Report.

GRAIN-ORIENTED ELECTRICAL STEEL SHEET AND PRODUCTION METHOD THEREFOR

TECHNICAL FIELD

This disclosure relates to grain-oriented electrical steel sheets used for iron cores of transformers, for example, and to production methods therefor.

BACKGROUND

Transformers in which grain-oriented electrical steel sheets are used are required to have low iron loss and low noise properties. In order for a transformer to have lower iron loss, it is effective to reduce the iron loss of the grain-oriented electrical steel sheet itself, and as one of the techniques for doing so, it is necessary to irradiate the surface of the steel sheet with laser beams, plasma, electron beams, or the like. JP2012036450A (PTL 1) teaches a technique for reducing iron loss by optimizing the interval between irradiation points and irradiation energy when introducing thermal strain to a surface of a grain-oriented electrical steel sheet in a dot-sequence manner by electron beam irradiation in a direction transverse to a rolling direction. This technique reduces iron loss by not only refining main magnetic domains but also forming an additional magnetic domain structure, called closure domains, inside the steel sheet.

As closure domains increase, however, this technique has a disadvantage in noise performance when incorporated in a transformer. The reason is that since the magnetic moment of closure domains is oriented in a plane orthogonal to the rolling direction, magnetostriction occurs as the orientation changes towards the rolling direction during the excitation process of the grain-oriented electrical steel sheet. The steel sheet also contains other closure domains called "lancet domains", and magnetostriction also occurs as a result of generation and disappearance of such lancet domains during excitation with alternating magnetic fields. It is known that lancet domains can be reduced by applying tension, for example, and the reduction of lancet domains can yield improved magnetostriction properties. On the other hand, closure domains caused by magnetic domain refinement as described above also cause magnetostriction and deterioration of transformer noise performance. Therefore, there is demand for optimization of not only lancet domains but also closure domains in order to achieve both low iron loss and low noise properties.

Conventional techniques for improving iron loss properties and noise performance with electron beam methods are described below. JP2012172191A (PTL 2) teaches a technique for providing a grain-oriented electrical steel sheet exhibiting excellent iron loss properties and noise performance by adjusting, in the case of performing magnetic domain refining treatment by irradiating with an electron beam in point form, the relationship between holding time t at each irradiation point and interval X between irradiation points in accordance with the output of the electron beam. JP2012036445A (PTL 3) describes a grain-oriented electrical steel sheet in which magnetic domain refining treatment is performed with electron beam irradiation and the relationship between diameter A of a thermal strain introduction region and irradiation pitch B is optimized.

WO2014068962A (PTL 4) describes a technique for optimizing, using an electron beam method, the rolling-direction width and the thickness-direction depth of closure domains as well as the interval at which closure domains are introduced in the rolling direction.

CITATION LIST

Patent Literature

PTL 1: JP2012036450A
PTL 2: JP2012172191A
PTL 3: JP2012036445A
PTL 4: WO2014068962A

SUMMARY

Technical Problem

However, in PTLs 2 and 3, electron beam irradiation is carried out in a dot-sequence manner, the resulting closure domains are not optimized adequately in terms of shape from the perspective of achieving both low iron loss and low noise properties. Regarding the technique of PTL 4, in view of the fact that the steel sheet has low iron loss and involves closure domains large in volume and large in rolling-direction width, it is estimated that the steel sheet has a small building factor. However, in order for closure domains to be formed to a predetermined depth in the sheet thickness direction, the magnetostriction tends to become significant in the sheet thickness direction. Thus, the technique of PTL 4 is not suitable for use in transformers in which greater importance is placed on noise performance.

It would thus be helpful to provide a grain-oriented electrical steel sheet with low iron loss and low noise when incorporated in a transformer and a production method therefor.

Solution to Problem

Although the idea of such closure domain formation already exists, we discovered that forming closure domains with a large depth in the sheet thickness direction and with a small volume (which is defined herein as "average closure domain width in the rolling direction $W_{ave}$*maximum depth D/periodic interval s") is effective for achieving both low iron loss and low noise properties of a transformer. We also found that the electron beam method is most advantageous as a method of introducing such closure domains. The reason is that the electron beam has high permeability to the interior of a steel sheet, which enables introducing strain and closure domains to a larger depth in the sheet thickness direction from the irradiated surface.

We also revealed that a better balance between iron loss properties and noise performance than in the conventional techniques can be achieved by forming closure domains in a steel sheet surface such that their width periodically varies in the rolling direction and by optimizing the ratio of $W_{max}/W_{min}$, where $W_{max}$ and $W_{min}$ respectively denote a maximum width and a minimum width in the rolling direction, using an electron beam method with extremely high beam controllability and high position controllability.

Finally, we discovered optimum electron beam irradiation conditions for forming closure domains satisfying these conditions. Specifically, we found a technique to make the diameter of a high accelerating voltage beam smaller than was conventionally the case, and to provide high-speed control of beam retention and movement.

The present disclosure was completed based on these discoveries, and primary features thereof are as described below.

(1) A grain-oriented electrical steel sheet with a plurality of strain regions locally present in a surface layer of the steel sheet and formed to extend in a direction transverse to a rolling direction at periodic interval s in millimeters in the rolling direction, wherein each of the strain regions has a closure domain region that is formed continuously over a distance of 200 mm in a width direction and whose width as measured in the rolling direction varies periodically on a surface of the steel sheet, and each of the closure domain regions satisfies a set of conditions including: a ratio of $W_{max}/W_{min}$ being 1.2 or more and less than 2.5, where $W_{max}$ and $W_{min}$ respectively denote a maximum width and a minimum width on the surface of the steel sheet as measured in the rolling direction; $W_{ave}$ being 80 μm or more, where $W_{ave}$ denotes an average width on the surface of the steel sheet as measured in the rolling direction; D being 32 μm or more, where D denotes a maximum depth as measured in the sheet thickness direction; and $(W_{ave}*D)/s$ being 0.0007 mm or more and 0.0016 mm or less.

(2) A method for use in producing the grain-oriented electrical steel sheet according to (1), the method comprising: irradiating a surface of the grain-oriented steel sheet with an electron beam while scanning the electron beam in a scanning direction transverse to a rolling direction under a set of electron beam irradiation conditions including: an accelerating voltage being 90 kV or more; d1 being 80 μm or more and 220 μm or less, where d1 denotes a beam diameter as measured in a direction orthogonal to the scanning direction, d2 being (0.8*d1) μm or more and (1.2*d1) μm or less, where d2 denotes a beam diameter as measured in the scanning direction, a beam profile having a Gaussian shape, and the scanning of the electron beam being performed while repeating a process to stop and resume movement by a traveling distance p of the electron beam on the surface, where $1.5*d2 \leq p \leq 2.5*d2$.

(3) The method according to (2), wherein the movement of the electron beam is stopped for 2 μs or more and the scanning is performed with an average rate of 100 m/s or higher.

(4) The method according to (2), wherein the movement of the electron beam is stopped for 8 μs or more and the scanning is performed with an average rate of 30 m/s or higher.

(5) The method according to any one of (2) to (4), wherein the electron beam is scanned on the surface over a scanning distance as measured in the width direction of 200 mm or more.

(6) The method according to any one of (2) to (4), wherein the electron beam is scanned on the surface over a scanning distance as measured in the width direction of 300 mm or more.

(7) The method according to any one of (2) to (6), wherein the electron beam is sourced from $LaB_6$.

(8) The method according to any one of (2) to (7), wherein the electron beam is converged using at least two coils.

Advantageous Effect

The grain-oriented electrical steel sheet according to the disclosure has low iron loss properties and exhibits low noise performance when incorporated in a transformer. According to the method for use in producing the grain-oriented electrical steel sheet disclosed herein, it is also possible to obtain a grain-oriented electrical steel sheet having low iron loss properties and exhibiting low noise performance when incorporated in a transformer.

DETAILED DESCRIPTION

<Grain-Oriented Electrical Steel Sheet>

First, a grain-oriented electrical steel sheet according to one of the embodiments disclosed herein (hereinafter, also referred to simply as "steel sheet") will be described.

No limitation is placed on the type (such as the chemical composition or structure) of the grain-oriented electrical steel sheet used in the disclosure, and any type of grain-oriented electrical steel sheets can be used.

The grain-oriented electrical steel sheet of this embodiment has a tension coating formed on a surface thereof. No limitation is placed on the type of tension coating, and one example may be a two-layer coating combining a forsterite coating which is mainly composed of $Mg_2SiO_4$ and formed during final annealing and a phosphate-based tension coating formed thereon. It is also possible to form a phosphate-based tension-applying insulating coating directly on the surface of the steel sheet on which no forsterite coating is formed. The phosphate-based tension-applying insulating coating may be formed, for example, by coating a surface of a steel sheet with an aqueous solution containing a metal phosphate and silica as main components, and baking the coating onto the surface.

In the grain-oriented electrical steel sheet of this embodiment, a surface of the grain-oriented electrical steel sheet is irradiated with an electron beam while scanning the electron beam on the surface in a direction transverse to a rolling direction, whereby a plurality of strain regions are caused to locally present in a surface layer of the steel sheet and formed to extend in the direction transverse to the rolling direction at periodic interval s in millimeters in the rolling direction. In each strain region, a closure domain region is formed.

In this embodiment, the tension coating is not damaged by electron beam irradiation. This eliminates the need for recoating for repairing purpose after the electron beam irradiation. There is thus no need to unduly increase the thickness of the coating, and it is thus possible to increase the stacking factor of transformer iron cores assembled from the steel sheets. Moreover, the electron beam is advantageous in that it allows for high-speed and complicated control of positions at which the steel sheet is irradiated with the electron beam.

This embodiment is characterized by the discovery of conditions for closure domains to impart both low iron loss properties and low noise performance to the transformer, and such conditions will be described in detail below.

Figure 1:
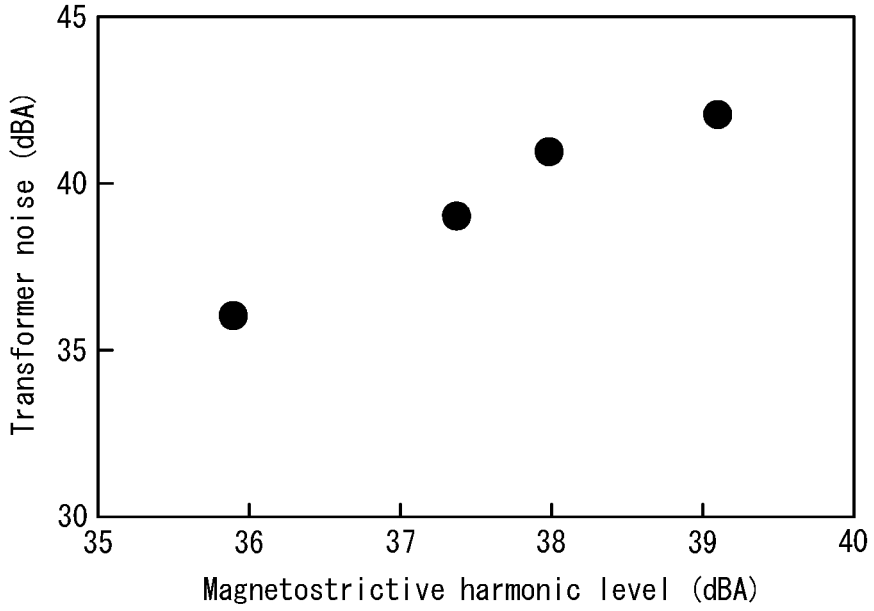
FIG. 1 is a graph illustrating a relationship between the magnetostrictive harmonic level and the transformer noise.

We first noticed that in the electron beam irradiation method the magnetostrictive harmonic level is one of the magnetostrictive parameters having a good correlation with transformer noise. As used herein, "magnetostrictive harmonic level" refers to a value that is obtained in a range of 0 Hz to 1000 Hz by adding up the results from dividing a magnetostrictive waveform obtained with a laser Doppler-type vibrometer into velocity components at 100 Hz and weighting frequency components using A-scale frequency weighting. At the time of magnetostriction measurement, a maximum magnetic flux density at 1.5 T, which had highest correlation with transformer noise at the maximum magnetic flux density of from 1.3 T to 1.8 T, was used. FIG. 1 is a graph illustrating the relationship between the magnetostrictive harmonic level and the transformer noise when magnetic domain refinement was performed under different electron beam conditions on grain-oriented electrical steel sheets of 0.23 mm in thickness, each having a forsterite film and a phosphate-based tension coating on a surface thereof. As is apparent from FIG. 1, the magnetostrictive harmonic level correlated well with the transformer noise. Therefore, in some experiments below, the magnetostrictive harmonic level was used as an index for the evaluation of noise.

As used herein, parameters relating to closure domain structure are defined as:

$W_{max}$: a maximum width of a closure domain region on the surface of the steel sheet as measured in the rolling direction (see FIG. 2)

$W_{min}$: a minimum width of a closure domain region on the surface of the steel sheet as measured in the rolling direction (see FIG. 2)

$W_{ave}$: an average width of a closure domain region on the surface of the steel sheet as measured in the rolling direction D: a maximum depth as measured in the sheet thickness direction The periodic interval at which closure domains are formed in the rolling direction are substantially equal to periodic interval s at which strain regions are formed in the rolling direction.

The width of a closure domain as measured in the rolling direction is determined by observing magnetic domains on the surface of the steel sheet using a magnet viewer containing a magnetic colloidal solution. As used herein, "average width $W_{ave}$" refers to an arithmetic mean of a maximum width $W_{max}$ and a minimum width $W_{min}$. Maximum depth D of closure domain represents the maximum amount of reduction in thickness, when reducing the thickness of the steel sheet in a stepwise manner with chemical polishing, in which the closure domain could be observed following the above-described observation procedure.

[Maximum Depth D as Measured in the Sheet Thickness Direction=32 μm or more]

It is believed that the depth of closure domains affects the iron loss properties. Although a larger depth is more preferable for obtaining an increased magnetic domain refining effect, excessively increasing the depth ends up increasing the volume of the closure domain, causing magnetostriction to increase. Therefore, the maximum depth D in the sheet thickness direction is preferably set to 32 μm or more and 50 μm or less.

[$(W_{ave}*D)/s$=0.0007 mm or More and 0.0016 mm or Less]

Figure 3:
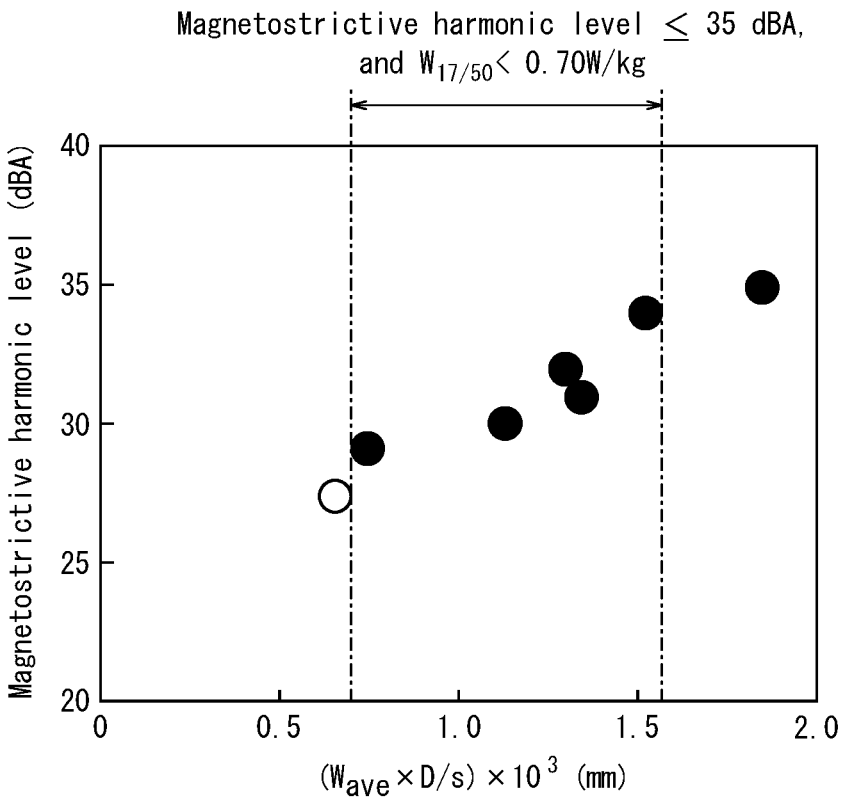
FIG. 3 is a graph illustrating the relationship between the magnetostrictive harmonic level and the value of (average width in the rolling direction $W_{ave}$*maximum depth D)/periodic interval s for the closure domain region.

We found that low noise performance can be obtained by reducing the volume of the closure domain. FIG. 3 is a graph illustrating the relationship between the magnetostrictive harmonic level and the value of $(W_{ave}*D)/s$ when magnetic domain refinement was performed under different electron beam conditions on grain-oriented electrical steel sheets of 0.23 mm in sheet thickness, each having a forsterite film and a phosphate-based tension coating formed on a surface thereof, to form magnetic domains therein with different beaded shapes (with which the width of the magnetic domain periodically changes). In the figure, white dots represent data with iron loss $W_{17/50}$ of 0.70 W/kg or higher. The smaller the value of $(W_{ave}*D)/s$, the lower the magnetostrictive harmonic level and the lower noise performance can be obtained. From this perspective, the value of $(W_{ave}*D)/s$ is set to 0.0016 mm or less in this embodiment. On the other hand, excessively reducing the value of $(W_{ave}*D)/s$ is less effective for increasing the magnetic domain refining effect and causes an increase in iron loss. From this perspective, the value of $(W_{ave}*D)/s$ is set to 0.0007 mm or more in this embodiment.

[Closure Domain's Shape on the Surface of the Steel Sheet]

Figure 2A:
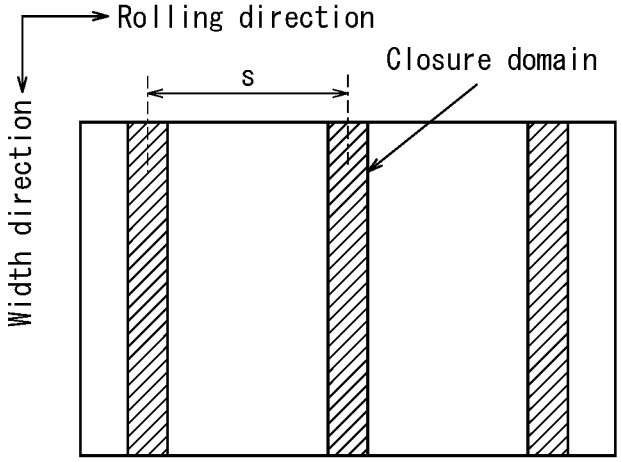
FIG. 2A is a schematic view of a steel sheet surface illustrating the shape of closure domain in a comparative example.
Figure 2B:
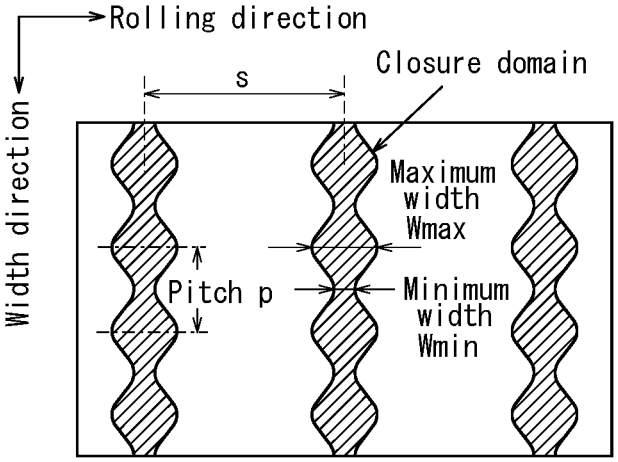
FIG. 2B is a schematic view of a steel sheet surface illustrating the shape of closure domain in one of the embodiments disclosed herein.
Figure 4:
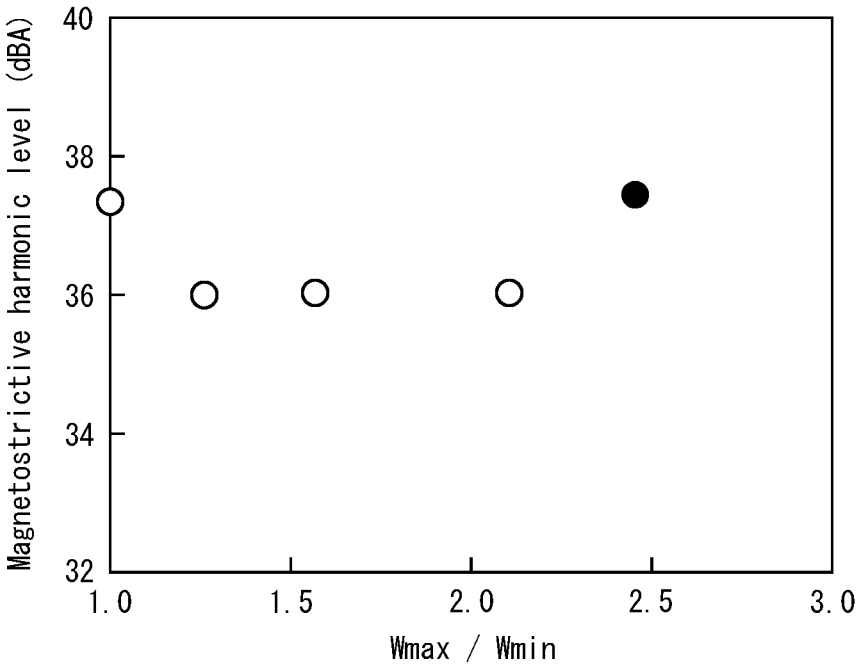
FIG. 4 is a graph illustrating the relationship between the magnetostrictive harmonic level and the ratio of $W_{max}/W_{min}$, where $W_{max}$ and $W_{min}$ respectively denote a maximum width and a minimum width of the closure domain region as measured in the rolling direction.

Subsequently, the closure domain's shape on the surface of the steel sheet was changed by varying the electron beam conditions (beam retention interval and beam current), with maximum depth D of closure domain being set to 36 μm and periodic interval s to 5 mm. As a result, it was found that such a closure domain shape as shown in FIG. 2B, with which the width on the surface of the steel sheet as measured in the rolling direction changes in a continuous and periodic manner in the width direction, can yield an even lower magnetostrictive harmonic level as compared with a linear closure domain shape as illustrated in FIG. 2A. FIG. 4 illustrates the relationship between the magnetostrictive harmonic level and the ratio of $W_{max}/W_{min}$. Regarding the average width, the white dots represent an average width from 200 μm to 220 μm, while the black dot represents a slightly larger width of 270 μm. The magnetostrictive harmonic level was lowered in the case of the ratio of $W_{max}/W_{min}$ being 1.2 or more and less than 2.5 as compared to the case of the ratio of $W_{max}/W_{min}$ being 1.0, i.e., linear closure domain. The iron loss was almost the same. Therefore, the ratio of $W_{max}/W_{min}$ is set to 1.2 or more and less than 2.5 in this embodiment.

Each closure domain region is preferably formed on the surface of the steel sheet continuously over a distance of 200 mm or more in the width direction, and more preferably formed continuously across the entire width. The reason is that a distance of less than 200 mm leads to an increased number of joints of closure domain regions being formed in the width direction, and thus increases in the non-uniformity of the magnetic domain structure of the steel sheet, causing the magnetic properties to deteriorate.

[Average Width $W_{ave}$ on the Surface of the Steel Sheet as Measured in the Rolling Direction=80 μm or More]

$W_{ave}$ of less than 80 μm is too narrow to obtain a sufficient magnetic domain refining effect. Therefore, $W_{ave}$ is set to 80 μm or more in this embodiment. $W_{ave}$ is preferably 250 μm or less. This is because $W_{ave}$ greater than 250 μm tends to increase the magnetostriction.

<Method of Producing the Grain-Oriented Electrical Steel Sheet>

A method for use in producing a grain-oriented electrical steel sheet according to one of the embodiments disclosed herein is a method for use in producing the above-described grain-oriented electrical steel sheet, comprising irradiating a surface of the grain-oriented electrical steel sheet with an electron beam while scanning the electron beam in a direction transverse to a rolling direction to form the strain regions as described above.

As a result of our intensive studies, we discovered electron beam irradiation conditions suitable for satisfying the above-described closure domain conditions.

[Accelerating Voltage Va=90 kV or More and 300 kV or Less]

Figure 5:
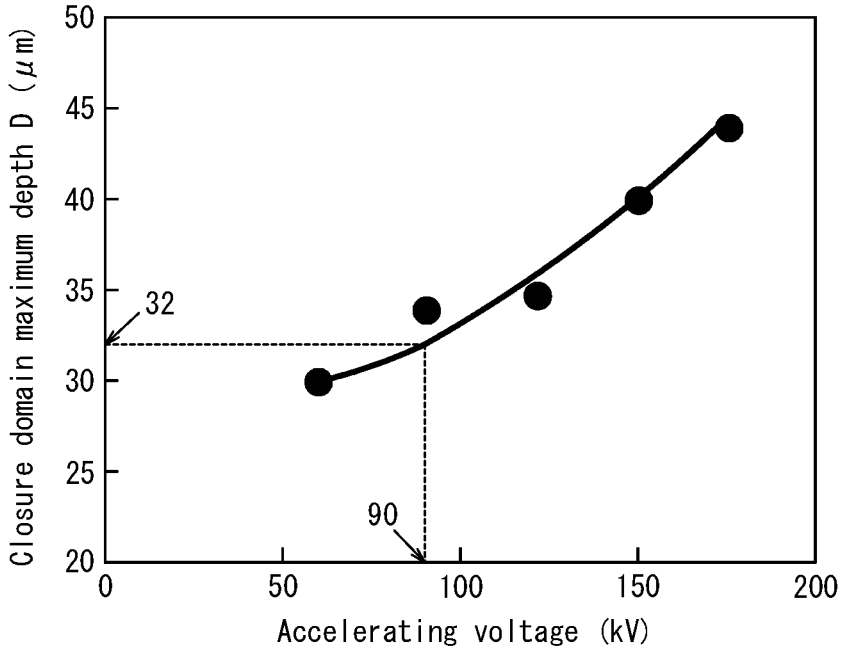
FIG. 5 is a graph illustrating the relationship between the accelerating voltage of the electron beam and the maximum depth D of the closure domain region.

A higher electron-beam accelerating voltage is more preferable. The reason is that a higher accelerating voltage increases the ability of the electron beam to permeate through substances, which not only enables the electron beam to permeate through the coating more easily so that the damage to the coating is likely to be suppressed, but also allows a closure domain region to be formed in the strain region at a desired depth in the sheet thickness direction. In this embodiment, it is necessary to reduce the beam diameter as much as possible in order to reduce the volume of closure domains formed, as described later. In this respect, a higher accelerating voltage is also advantageous in that it tends to provide a smaller beam diameter. FIG. 5 is a graph illustrating the relationship between maximum depth D of closure domain region and the accelerating voltage of the electron beam when magnetic domain refinement was performed on grain-oriented electrical steel sheets of 0.23 mm in thickness, each having a forsterite film and a phosphate-based tension coating formed on a surface thereof, under a set of predetermined electron beam conditions (beam diameter: 200 μm; scanning rate: 30 m/s; and scanning direction: width direction). For all grain-oriented electrical steel sheets, iron loss at $W_{17/50}$ was lower than 0.70 W/kg. Under these conditions, setting the accelerating voltage to 90 kV or more can provide maximum depth D in the sheet thickness direction of 32 μm or more. Alternatively, the closure domain depth may be increased by optimizing the other beam conditions without changing the accelerating voltage. For example, strain can be introduced to a deeper region under the influence of heat conduction resulting from irradiating with the electron beam at one location for a long period of time.

On the other hand, as the accelerating voltage increases, it becomes difficult to provide a shield from x-rays originating from the irradiated object. Therefore, a preferred upper limit is practically about 300 kV. A preferred lower limit for the accelerating voltage is 150 kV.

[Beam Diameter Dl in a Direction Orthogonal to the Scanning Direction=80 μm or More and 220 μm or Less]

In this embodiment, the diameter of the electron beam is reduced to decrease the volume of closure domains. Specifically, beam diameter d1 is set to 220 μm or less. Excessively decreasing the beam diameter and the width of closure domains is less effective for increasing the magnetic domain refining effect. Therefore, beam diameter d1 is set to 80 μm or more. A more preferable range of beam diameter d1 is from 100 μm to 150 μm.

[Beam Diameter d2 in the Scanning Direction=(0.8*d1) μm or More and (1.2*d1) μm or less]

We also revealed that in the case of scanning a beam while repeating a process to stop and resume its movement, the beam shape should be closer to a perfect circle. The reason is that if the beam assumes an elliptical shape, the beam decreases in energy density and the beam current should be increased to produce higher energy, leading to an increase in beam diameter. From this perspective, beam diameter d2 is set in a range of (0.8*d1) μm to (1.2*d1) μm.

As used herein, for both d1 and d2, "beam diameter" is defined as the half width of the beam profile as measured by the slit method (slit width: 0.03 mm).

[Beam Profile=Gaussian Shape]

Figure 6:
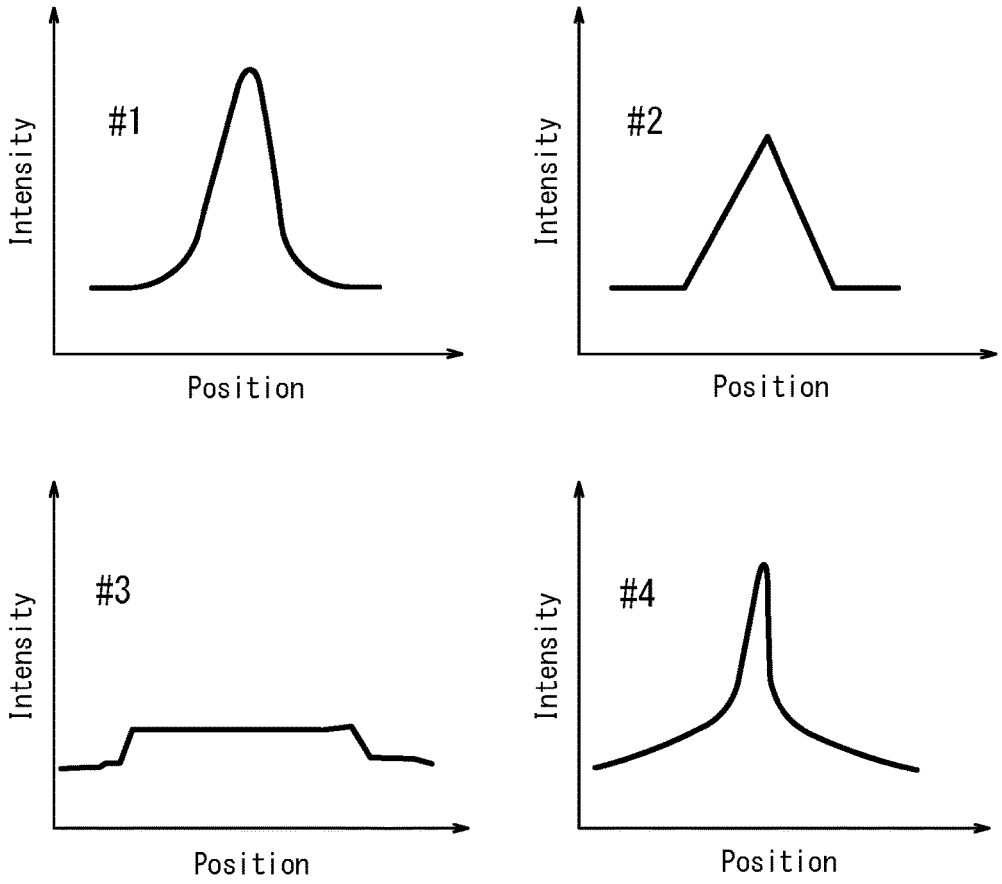
FIG. 6 is a graph illustrating the shape of various beam profiles.

We found that the electron beam takes different profile shapes depending on how it is converged, and can be roughly divided into four shape categories as illustrated in FIG. 6. Among these, beam #1 has the highest energy density and is effective for lowering iron loss. In other words, when irradiating with beam #2, #3, or #4 with a lower energy density, it is difficult to form closure domains at a desired depth. If some measures are taken to increase the energy density, such as by increasing the beam current to form closure domains at a desired depth, however, the width of closure domains increases, which ends up increasing the iron loss. In this embodiment, a beam as indicated by #1 is referred to as a "Gaussian shaped beam", which is defined herein to have a beam width (beam diameter) at one-half (½) intensity of 265 μm or less, with the ratio of the beam width at one-half (½) intensity to a beam width at one-fifth (⅕) intensity being 3.0 or less.

[Line Angle: 60° or More and 120° or Less]

The electron beam is linearly scanned in a direction forming an angle of 60° or more and 120° or less with the rolling direction. As this angle deviates from 90°, the volume of strain-introduced regions increases. Therefore, this angle is desirably set to 90°.

[Electron Beam Irradiation Pattern]

The electron beam is scanned to form strain regions in a manner such that they are continuously distributed in the width direction on the steel sheet being passed. At this time, the electron beam is scanned on the steel sheet with an average scanning rate of preferably 30 m/s or higher. An average scanning rate below 30 m/s cannot yield high productivity. The average scanning rate is desirably 100 m/s or higher. A preferred upper limit for the average scanning rate is 300 m/s in order to enable high-speed repetitive control of stopping and resuming of movement of the beam. It is noted here that the scanning rate is constant during the scanning of the electron beam and that "average scanning rate" refers to an average scanning rate including beam stop time.

When scanning an electron beam at this high rate, it is preferable to keep the electron beam in an irradiation state on a constant basis to avoid wasting time for on/off control of the beam. In this case, to periodically change the closure domain width in the width direction as described above, the beam irradiation may be performed by repeating a process to stop and resume the scanning of the beam, rather than scanning the beam at a constant rate along the width direction. The distance (traveling distance) p between adjacent beam retention points is set to satisfy the following relation: scanning-direction beam diameter d2*1.5≤p≤scanning-direction beam diameter d2*2.5. If p is smaller than d2*1.5, closure domains will be formed in a continuous shape. If p is larger than d2*2.5, closure domains will be formed discontinuously in the width direction or the width ratio (Wmax/Wmin) will excessively increase.

To form the aforementioned closure domains, it is necessary to stop the movement of the beam for as long a period as possible at each beam retention point. When the average scanning rate is 100 m/s or higher, the beam needs to be retained for at least 2 μs. When the average scanning rate is 30 m/s or higher, this effect can be further enhanced if the beam is retained for 8 μs or more. An upper limit for the beam retention time is preferably 20 μs from the perspective of suppressing damage to the coating.

[Irradiation Line Interval: 15 mm or Less]

Electron beam irradiation is preferably performed so that closure domain regions can be formed along the width direction at periodic interval s in the rolling direction of 15 mm or less. The reason is that excessively increasing the irradiation line interval is less effective for increasing the magnetic domain refining effect, and thus makes less contribution to the improvement of iron loss properties. No particular limitations are placed on the lower limit for the line interval, yet the lower limit is restricted to some extent by the volume of closure domains as described above. If the line interval is excessively small, however, productivity deteriorates. Therefore, a preferred lower limit is 5 mm. In addition, the line interval needs to be set so that $(W_{ave}*D)/s$ is in a range of 0.0007 mm to 0.0016 mm.

[Beam Current: 0.5 mA or More and 30 mA or Less]

A lower beam current is preferred from the perspective of beam diameter reduction. The reason is that when more charged particles repel one another, it is hard to converge the beam. Therefore, the upper limit for the beam current is set to 30 mA. The beam current is more preferably 20 mA or less. On the other hand, if the beam current is excessively low, the magnetic domain refining effect cannot be obtained. Therefore, the lower limit is 0.5 mA.

[Pressure in a Processing Chamber: 3 Pa or Less]

The electron beam increases in diameter when scattered by gas molecules, and thus requires a pressure of 3 Pa or less. The lower limit for the pressure is practically about $10^{-5}$ Pa considering the fact that excessively decreasing the lower limit would cause a rise in the cost of the vacuum system such as a vacuum pump.

[Working Distance (WD): 1000 mm or Less]

Working distance (WD) refers to the distance from the center of the focus coil to the steel sheet surface. This distance has a significant influence on the beam diameter. When the WD is reduced, the beam path is shortened and the beam converges more easily. Therefore, the WD is preferably 1000 mm or less.

[Coil Arrangement: Two-Stage Focus Coil]

To form the aforementioned Gaussian-shaped electron beam on the steel sheet, it is necessary to forcedly converge electrons emitted from a thermal electron source through a focus coil. However, when electrons are accelerated at high voltage, they pass through the focus coil in a very short time in which they will not be able to acquire sufficient convergence ability or a desired profile. Although a method of increasing magnetic field strength by increasing the coil current is known, an excessively large amount of heat is generated in the coil and the circuit board related to the convergence. Therefore, using at least two focus coils makes it possible to disperse heat and stably form a Gaussian-shaped beam.

[Scanning Distance of the Electron Beam Along the Width Direction on the Surface of the Steel Sheet: 200 mm or More]

As the scanning distance in the width direction of the electron beam on the surface of the steel sheet increases, the number of electron guns necessary to irradiate a wide coil with the electron beam decreases. For example, in the case of a coil having a width of 1000 mm, five electron guns are required for a scanning distance of 200 mm and twenty for 50 mm. Therefore, in view of production efficiency and maintainability, the scanning distance is preferably as large as possible. Therefore, the scanning distance is set to 200 mm or more. A preferred scanning distance is 300 mm or more. If the scanning distance is excessively increased, however, it is necessary to increase the WD or the deflection angle. In the former case, the problem of an increased beam diameter arises, while in the latter case, deflection aberration is more pronounced and the deflected beam assumes an elliptical shape on the steel sheet, which is not preferable from the perspective of beam diameter reduction. Therefore, the upper limit for the scanning distance is preferably 650 mm.

[Electron Beam Source: $LaB_6$]

In general, $LaB_6$ is known to be advantageous for outputting a high intensity beam and for facilitating beam diameter reduction, and thus is preferably used.

EXAMPLES

Grain-oriented electrical steel sheets of 0.23 mm in thickness, each having a forsterite film and a phosphate-based tension coating on a surface thereof, were subjected to magnetic domain refining treatment under various electron beam irradiation conditions as listed in Table 1. The magnetic flux density $B_8$ upon magnetization at 800 A/m was approximately 1.935 T. The scanning direction of the electron beam was perpendicular to the rolling direction of the steel sheet and the processing chamber pressure was 0.02 Pa. The beam current was adjusted in an output range of 1 kW to 3 kW. WD was set to 300 mm for No. 12 and 900 mm for the rest. In the profile shape column of Table 1, "#1" denotes a Gaussian shape comparable to #1 in FIG. 6 and "#4" denotes a shape comparable to #4 in FIG. 6.

TABLE 1

| No. | Accelerating voltage [kV] | Beam diameter in width direction d1 [μm] | Beam diameter in rolling direction d2 [μm] | d1/d2 | Profile shape | Average scanning rate [m/s] | Travelling distance P [mm] | p [μm]/d2 [μm] | Beam stop time [μsec] | Line interval in rolling direction s [mm] | Scanning distance in width direction [mm] | Electron source | Focus coil arrangement |
|---|---|---|---|---|---|---|---|---|---|---|---|---|---|
| 1 | 150 | 165 | 165 | 1.0 | #1 | 100 | 0.3 | 1.8 | 2.3 | 7.2 | 320 | $LaB_6$ | two-stage |
| 2 | 150 | 190 | 190 | 1.0 | #1 | 100 | 0.35 | 1.8 | 2.0 | 7.5 | 320 | $LaB_6$ | two-stage |
| 3 | 150 | 270 | 260 | 1.0 | #1 | 100 | 0.3 | 1.2 | 2.3 | 7.0 | 320 | $LaB_6$ | two-stage |
| 4 | 150 | 140 | 140 | 1.0 | #4 | 100 | 0.3 | 2.1 | 2.3 | 6.7 | 320 | $LaB_6$ | two-stage |
| 5 | 150 | 140 | 140 | 1.0 | #1 | 30 | 0.3 | 2.1 | 5.0 | 5.5 | 320 | $LaB_6$ | two-stage |
| 6 | 150 | 140 | 140 | 1.0 | #1 | 30 | 0.3 | 2.1 | 9.2 | 5.5 | 320 | $LaB_6$ | two-stage |
| 7 | 150 | 160 | 170 | 0.9 | #1 | 100 | 0.2 | 1.2 | 1.1 | 7.0 | 320 | $LaB_6$ | two-stage |
| 8 | 150 | 165 | 160 | 1.0 | #1 | 100 | 0.5 | 3.1 | 4.2 | 7.0 | 320 | $LaB_6$ | two-stage |
| 9 | 150 | 170 | 170 | 1.0 | #1 | 100 | 0.4 | 2.4 | 3.5 | 4.5 | 320 | $LaB_6$ | two-stage |

TABLE 1-continued

| No. | Accelerating voltage [kV] | Beam diameter in width direction d1 [μm] | Beam diameter in rolling direction d2 [μm] | d1/d2 | Profile shape | Average scanning rate [m/s] | Travelling distance P [mm] | p [μm]/d2 [μm] | Beam stop time [μsec] | Line interval in rolling direction s [mm] | Scanning distance in width direction [mm] | Electron source | Focus coil arrangement |
|---|---|---|---|---|---|---|---|---|---|---|---|---|---|
| 10 | 120 | 320 | 240 | 1.4 | #1 | 100 | 0.6 | 2.5 | 5.0 | 6.7 | 320 | $LaB_6$ | two-stage |
| 11 | 150 | 75 | 70 | 1.1 | #1 | 30 | 0.12 | 1.7 | 3.5 | 4.0 | 100 | $LaB_6$ | two-stage |
| 12 | 150 | 170 | 240 | 0.7 | #1 | 100 | 0.3 | 1.3 | 2.3 | 6.0 | 320 | $LaB_6$ | two-stage |
| 13 | 150 | 220 | 200 | 1.1 | #1 | 100 | 0.1 | 0.5 | <1 (N/A) | 7.0 | 320 | Tungsten | two-stage |
| 14 | 150 | 220 | 200 | 1.1 | #1 | 100 | 0.35 | 1.8 | 3.0 | 7.0 | 320 | Tungsten | two-stage |
| 15 | 120 | 220 | 230 | 1.0 | #1 | 100 | 0.55 | 2.4 | 5.0 | 8.0 | 320 | $LaB_6$ | two-stage |
| 16 | 120 | 220 | 230 | 1.0 | #1 | 100 | 0.1 | 0.4 | <1 (N/A) | 8.0 | 320 | $LaB_6$ | two-stage |
| 17 | 150 | 190 | 190 | 1.0 | #1 | 100 | 0.4 | 2.1 | 3.0 | 7.2 | 220 | $LaB_6$ | single-stage |

Table 2 indicates the presence/absence of damage to the coating due to magnetic domain refinement, dimensions of closure domain region, iron loss $W_{17/50}$, and harmonic level $MHL_{15/50}$.

TABLE 2

| No. | Damage to coating | Distance over which a single closure domain extends continuously in width direction [mm] | Average width $W_{ave}$ [μm] | Width ratio $W_{max}/W_{min}$ | Maximum depth D [μm] | (Wave * D)/s * 1000 [mm] | $W_{17/50}$ [W /kg] | $MHL_{15/50}$ [dBA] | Remarks |
|---|---|---|---|---|---|---|---|---|---|
| 1 | None | 320 | 160 | 1.5 | 42 | 0.93 | 0.67 | 29 | Example |
| 2 | None | 320 | 185 | 1.5 | 44 | 1.09 | 0.67 | 29 | Example |
| 3 | None | 320 | 240 | 1.4 | 29 | 1.03 | 0.69 | 29 | Comparative Example |
| 4 | None | 320 | 135 | 1.3 | 31 | 0.64 | 0.69 | 27 | Comparative Example |
| 5 | None | 320 | 130 | 1.6 | 42 | 0.99 | 0.67 | 29 | Example |
| 6 | None | 320 | 140 | 1.5 | 44 | 1.12 | 0.66 | 29 | Example |
| 7 | None | 320 | 150 | 1.1 | 39 | 0.84 | 0.67 | 29 | Comparative Example |
| 8 | None | 320 | 140 | 2.5 | 45 | 0.90 | 0.68 | 31 | Comparative Example |
| 9 | None | 320 | 165 | 1.6 | 45 | 1.65 | 0.71 | 33 | Comparative Example |
| 10 | None | 320 | 230 | 2.2 | 50 | 1.72 | 0.71 | 34 | Comparative Example |
| 11 | None | 100 | 70 | 1.3 | 45 | 0.79 | 0.70 | 28 | Comparative Example |
| 12 | None | 320 | 230 | 1.1 | 46 | 1.76 | 0.72 | 34 | Comparative Example |
| 13 | None | 320 | 185 | 1.0 | 36 | 0.95 | 0.67 | 31 | Comparative Example |
| 14 | None | 320 | 190 | 1.3 | 40 | 1.09 | 0.67 | 30 | Example |
| 15 | None | 320 | 220 | 1.5 | 40 | 1.10 | 0.68 | 30 | Example |
| 16 | None | 320 | 210 | 1.0 | 36 | 0.95 | 0.68 | 31 | Comparative Example |
| 17 | None | 220 | 170 | 1.5 | 40 | 0.94 | 0.67 | 29 | Example |

According to the disclosure, when using a $LaB_6$ cathode at an accelerating voltage of 150 kV and performing electron beam irradiation under the conditions specified herein, low iron loss and low magnetostriction properties were obtained, namely, iron loss $W_{17/50}$ was as low as 0.66 W/kg to 0.68 W/kg and magnetostrictive harmonic level $MHL_{15/50}$ as low as 29 dBA. When using a tungsten cathode, iron loss was as low as 0.67 W/kg and magnetostriction as low as 30 dBA. Additionally, in the case of using a single-stage focus coil at the $LaB_6$ cathode, iron loss was as low as 0.67/kg and magnetostriction as low as 29 dBA. Furthermore, for No. 15 and No. 16, model transformers were made and subjected to noise measurement. The noise level was determined to be 33 dBA for No. 15 and 35 dBA for No. 16, and the measurement results demonstrated that reducing the magnetostrictive harmonic level contributes the reduction of transformer noise.

INDUSTRIAL APPLICABILITY

According to the present disclosure, it is possible to provide a grain-oriented electrical steel sheet that has low iron loss properties and exhibits low noise performance when incorporated in a transformer, and a production method therefor. Therefore, the present disclosure can improve the energy efficiency of the transformer and enables its application in broader environments.

The invention claimed is:

1. A grain-oriented electrical steel sheet with a plurality of strain regions locally present in a surface layer of the steel sheet and formed to extend in a direction transverse to a rolling direction at periodic interval s in millimeters in the rolling direction, wherein each of the strain regions has a closure domain region that is formed continuously over a distance of 200 mm in a width direction and whose width as measured in the rolling direction varies periodically on a surface of the steel sheet, and each of the closure domain regions satisfies a set of conditions including:

a ratio of $W_{max}/W_{min}$ being 1.2 or more and less than 2.5, where $W_{max}$ and $W_{min}$ respectively denote a maximum width and a minimum width on the surface of the steel sheet as measured in the rolling direction;

$W_{ave}$ being 80 μm or more, where $W_{ave}$ denotes an average width on the surface of the steel sheet as measured in the rolling direction;

D being 32 μm or more, where D denotes a maximum depth as measured in the sheet thickness direction; and $(W_{ave}*D)/s$ being 0.0007 mm or more and 0.0016 mm or less.

2. A method of producing the grain-oriented electrical steel sheet according to claim 1, the method comprising:

irradiating a surface of a grain-oriented steel sheet with an electron beam while scanning the electron beam in a scanning direction transverse to a rolling direction under a set of electron beam irradiation conditions including:

an accelerating voltage being 90 kV or more;

dl being 80 μm or more and 220 μm or less, where dl denotes a beam diameter as measured in a direction orthogonal to the scanning direction, d2 being (0.8 *dl) μm or more and (1.2*dl) μm or less, where d2 denotes a beam diameter as measured in the scanning direction, a beam profile having a Gaussian shape, and the scanning of the electron beam being performed while repeating a process to stop and resume movement by a moving distance p of the electron beam on the surface, where $1.5*d2 \leq p \leq 2.5*d2$, thereby producing the grain-oriented electrical steel sheet of claim 1.

3. The method according to claim 2, wherein the movement of the electron beam is stopped for 2 g±s or more and the scanning is performed with an average rate of 100 m/s or higher.

4. The method according to claim 2, wherein the movement of the electron beam is stopped for 8 g±s or more and the scanning is performed with an average rate of 30 m/s or higher.

5. The method according to claim 2, wherein the electron beam is scanned on the surface over a scanning distance as measured in the width direction of 200 mm or more.

6. The method according to claim 2, wherein the electron beam is scanned on the surface over a scanning distance as measured in the width direction of 300 mm or more.

7. The method according to claim 2, wherein the electron beam is sourced from $LaB_6$.

8. The method according to claim 2, wherein the electron beam is converged using at least two coils.

* * * * *